US005318002A

United States Patent [19]

Okuda

[11] Patent Number: 5,318,002

[45] Date of Patent: Jun. 7, 1994

[54] IGNITION APPARATUS FOR INTERNAL COMBUSTION ENGINE

[75] Inventor: Hiroshi Okuda, Himeji, Japan

[73] Assignee: Mitsubishi Denki Kabushiki Kaisha, Tokyo, Japan

[21] Appl. No.: 31,129

[22] Filed: Mar. 12, 1993

[30] Foreign Application Priority Data

Mar. 16, 1992 [JP] Japan ..... 4-057680

[51] Int. Cl.[5] ..... F02P 3/06

[52] U.S. Cl. ..... 123/598; 123/605

[58] Field of Search ..... 123/598, 604, 605

[56] References Cited

U.S. PATENT DOCUMENTS 4,696,280 9/1987 Niggemeyer ..... 123/598
5,074,274 12/1991 Okuda ..... 123/604
5,183,024 2/1993 Morita et al. ..... 123/598

*Primary Examiner*—Tony M. Argenbright

*Attorney, Agent, or Firm*—Sughrue, Mion, Zinn, Macpeak and Seas

[57] ABSTRACT

An ignition apparatus for an internal combustion engine realizes a stable ignition control by ensuring an adequate capacitor charge voltage even in a high-speed engine operation. The apparatus comprises a trigger circuit (50) which includes a pulse generator (30) for sustaining a trigger signal for a predetermined period required for a capacitor (8) to discharge, and a switch (40) for applying a voltage to a gate of a thyristor 12 by opening a short-circuit between gate and cathode thereof. The gate-cathode path of the thyristor is short-circuited upon charging of the capacitor and after discharging thereof, to thereby set a hold current for the thyristor at a high level so that after lapse of a predetermined time and a turn-off time from the beginning of the discharge of the capacitor, the DC-DC converter (2) is restarted to secure an adequate capacitor charge voltage (d).

2 Claims, 5 Drawing Sheets

IGNITION APPARATUS FOR INTERNAL COMBUSTION ENGINE

BACKGROUND OF THE INVENTION

1. Field of the Invention

The present invention relates generally to a capacitor discharge type ignition apparatus for an internal combustion engine (hereinafter also referred to simply as the engine). More particularly, the invention is concerned with an ignition apparatus for the engine which can ensure an adequately high charge voltage of a capacitor even in a high-speed operation of the engine to thereby stabilize ignition control.

2. Description of the Related Art

Heretofore, there is known such a capacitor discharge type ignition (CDI) apparatus for internal combustion engines in which a boosted voltage charged previously in a capacitor is discharged through a primary winding of an ignition coil, to thereby generate a spark discharge at a spark plug. This capacitor discharge type ignition apparatus is advantageous in that the ignition for firing a fuel mixture with an associated engine cylinder can positively be ensured even when the spark plug is in a stained state or when a battery of a small capacity is employed, because this type ignition apparatus features a short discharge time and a steep rise-up of the discharge current.

As a booster circuit for charging the capacitor of the ignition apparatus of the type mentioned above, a DC-DC converter is employed which includes a power transistor for turning on and off a booster coil in a repetitive manner.

FIG. 5 shows a circuit configuration of a capacitor discharge type ignition apparatus known heretofore in which a DC-DC converter is employed. Referring to the figure, a reference numeral 1 denotes a battery serving as a power supply source for supplying electric energy to the whole apparatus. Connected to the battery 1 is a DC-DC converter 2 which is comprised of a transformer type booster coil 3, a power transistor 4, a resistor 5, and diodes 6 and 7, which are connected in a manner as shown in the figure, to constitute a booster circuit for generating a boosted voltage by repeatedly turning on and off the power transistor 4 connected to the battery 1.

More specifically, the booster coil 3 includes a primary winding 3*a* having one end connected to the battery and the other end connected to a collector of the power transistor 4, a secondary winding 3*b* for outputting a boosted voltage from one end thereof through the diode 7 and a switching secondary winding 3*c* for turning on and off the power transistor 4 at a high frequency on the order of 20 kHz. Applied to a base electrode of the power transistor 4 together with a source voltage from the battery 1 via the base resistor 5 is an output voltage from the switching secondary winding 3*c* of the transformer type booster coil 3. The diode 6 serves to prevent a reverse bias voltage from being applied to the base of the power transistor 4.

A capacitor 8 is connected to an output terminal of the DC-DC converter 2 to be thereby charged with the boosted voltage which is outputted from the DC-DC converter 2. An ignition coil 9 has a primary winding 9*a* connected to the capacitor 8 and a secondary winding 9*b* connected to a spark plug 10 which serves to fire a fuel mixture within an associated engine cylinder. A fly-wheel diode 11 is connected across the primary winding 9*a* of the ignition coil 9.

A thyristor 12 is inserted in a discharge path of the capacitor 8 which includes the primary winding 9*a* of the ignition coil 9. This thyristor 12 is turned on in response to a trigger signal (described hereinafter) applied to the gate thereof. A resistor 13 of about 1 kΩ is connected between the gate and the cathode of the thyristor 12 and serves for determining a current value, i.e., a hold current $I_H$ in the off-state of the thyristor 12.

At this juncture, it should also be mentioned that a voltage detecting circuit is provided for detecting attainment of a capacitor charge voltage d to a predetermined voltage level, to thereby interrupt operation of the DC-DC converter 2, although illustration of such voltage detecting circuit is omitted.

An electromagnetic pickup or sensor 14 is disposed in opposition to an output shaft (not shown) of the engine for generating a ignition timing signal a at every predetermined crank angle. The ignition timing signal a is rectified by a diode 15 so that it assumes a positive polarity after the rectification. A resistor 16 serves to output the rectified ignition timing signal as the aforementioned trigger signal which is applied to the gate of the thyristor 12. As can easily be understood, the electromagnetic pickup 14, the diode 15 and the resistor 16 cooperate to constitute a trigger circuit for turning on the thyristor 12 in synchronism with the ignition timing signal generated at an ignition timing required for the desired engine operation.

A monostable multivibrator 17 is provided for generating a pulse c for stopping the voltage boost operation in response to the gate voltage b of the thyristor 12 derived from the trigger signal. More specifically, the monostable multivibrator 17 is so designed as to generate the boosting operation stop pulse c which has a duration extended by a turn-off period t1 taken for the thyristor 12 to become completely nonconducting upon falling of the gate voltage b. A transistor 18 which is turned on in response to the boosting operation stop pulse c is connected between the resistor 5 of the DC-DC converter 2 and the ground.

FIG. 6 is a circuit diagram showing, by way of example, a configuration of the monostable multivibrator 17. Referring to the figure, this monostable multivibrator 17 includes an input terminal 21 to which the gate voltage b is applied, an output terminal 22 for outputting the boosting operation stop pulse c, an emitter-grounded transistor 23 having a base connected to the input terminal 21, an emitter-grounded transistor 24 having a collector connected to the output terminal 22, a capacitor 25 inserted between the ground and a junction between the collector of the transistor 23 and the base of the transistor 24, and a resistor 26 inserted between the capacitor 25 and the battery.

In the monostable multivibrator shown in FIG. 6, when the gate voltage b is at a low level "L", the transistor 23 is in the off-state with the base potential of the transistor 24 being high "H". Consequently, the transistor 24 is also in the off-state. The boosting operation stop pulse c is thus at the low level "L". Assuming that the gate voltage b rises up to a high level "H", starting from the state mentioned above, the transistor 23 is turned on, to thereby render the base potential of the transistor 24 to be low "L". Accordingly, the transistor 24 is turned off, whereupon the boosting operation stop pulse c of the level "H" is outputted from the output terminal 22. At this time point, the electric charge stored in the capacitor 25 is drained to the ground through the collector-emitter path of the transistor 23. Subsequently, the gate voltage b falls to the level "L", and the transistor 23 is turned off. However, so long as the capacitor 25 is electrically charged, the base potential of the transistor 24 is inhibited from becoming high "H". After lapse of the charging time t1, the transistor 24 is turned on, as a result of which the boosting operation stop pulse c assumes the low level "L". The charging time t1 is previously so set as to coincide with the turn-off timing of the thyristor 12 by selecting appropriately the values of the capacitor 25 and the resistor 26.

FIG. 7 is a waveform diagram illustrating waveforms of the signals generated in the apparatus shown in FIG. 5. The signals a, c and d have already been mentioned. A waveform e is of a current which is discharged from the secondary winding 3b of the booster coil 3 when the thyristor 12 is turned on.

Now, by reference to FIG. 7, description will be directed to the operation of the known ignition apparatus shown in FIG. 6.

Ordinarily, the capacitor 8 is charged with a boosted voltage supplied from the DC-DC converter 2. When the electromagnetic pickup 14 generates the ignition timing signal a at a predetermined ignition timing determined by the engine operation as desired, starting from the above-mentioned state, the ignition timing signal a of positive polarity is applied to the gate of the thyristor 12 as the trigger signal by way of the resistor 16.

Thus, the thyristor 12 is turned on, whereby the charge voltage d of the capacitor 8 is instantaneously discharged through a discharge path including the primary winding 9a of the ignition coil 9 and the thyristor 12. Usually, the time taken for this discharge is on the order of 20 $\mu$ sec. Consequently, a high voltage is induced in the secondary winding 9b of the ignition coil 9, resulting in that a spark discharge takes place at the spark plug 10 to fire or ignite the fuel mixture within the associated engine cylinder at the desired ignition timing.

In the conducting state of the thyristor 12, the gate voltage b is continuously outputted. When the conducting current, i.e., the discharge current of the capacitor 8 becomes lower than the hold current $I_H$, the thyristor 12 is instantaneously turned off (i.e., becomes nonconducting).

On the other hand, when the trigger signal is outputted via the resistor 16, the monostable multivibrator 17 produces the boosting operation stop pulse c to thereby turn on the transistor 18, whereby the base current of the power transistor 4 is broken to stop the operation of the DC-DC converter 2. Subsequently, the thyristor 12 is turned off and the gate voltage b thus falls. After lapse of the turn-off period t1 of the thyristor 12, the boosting operation stop pulse c falls. Thus, operation of the DC-DC converter 2 is restarted to charge again the capacitor 8. In this manner, only after the thyristor 12 have assumed the intrinsically nonconducting state, the boosting oscillation takes place, whereby loss in the oscillation energy can be prevented.

More specifically, when the battery voltage is applied to the base of the power transistor 4 from the battery via the resistor 5, the power transistor 4 is turned on to allow the current to flow through the primary winding 3a of the booster coil 3. At that time, voltages of opposite polarities are induced in the secondary windings 3b and 3c, respectively. In that case, an alternating voltage of ca. 20 kHz is generated across the switching secondary winding 3c, whereby the power transistor 4 is turned on and off at a high frequency, to interrupt the conduction of the primary current. Thus, a boosted voltage is generated from one end of the secondary winding 3b to charge the capacitor 8.

Incidentally, the diode 6 functions to cut the component of negative polarity from the voltage generated across the switching secondary winding 3c to prevent a reverse bias from being applied to the base of the power transistor 4. Protection of the power transistor 4 against the reverse bias can thus be ensured.

When the charge voltage d of the capacitor 8 has attained a predetermined voltage due to repetition of the charging operation, the voltage detecting circuit (not shown) interrupts the operation of the DC-DC converter 2 to thereby protect the capacitor 8 from being overcharged.

In the normal operation, the trigger signal for the thyristor 12 is generated after the operation of the DC-DC converter 2 is stopped by the voltage detecting circuit. Thus, the DC-DC converter 2 is restarted upon lapse of the turn-off period after the discharge of the capacitor voltage d. However, in the high-speed operation of the engine, the time interval at which the ignition timing signal a is generated becomes shorter. Consequently, the trigger signal is generated during operation of the DC-DC converter 2, i.e., during electric conduction of the booster coil 3.

When the situation mentioned above takes place, the electromagnetic energy of the booster coil 3 which has usually a high impedance is discharged as a discharge current e (refer to FIG. 5). As a result of this, the conducting period of the thyristor 12 is correspondingly extended. In this conjunction, it is noted that since the gate voltage b continues to flow until the booster coil discharge current e diminishes below the hold current $I_H$.

For the reason described above, when the boosting operation stop pulse c is extended, as shown in FIG. 5, the DC-DC converter 2 remains inoperative during an correspondingly elongated period, involving a time lag in the timing for the restart of the DC-DC converter, which means that no adequate charge voltage d of the capacitor 8 can be obtained in the succeeding boosting oscillation cycle. In particular, in the high-speed engine operation, the trigger signal derived from the ignition timing signal a is generated at a short periodic interval, whereby the charge voltage d is further decreased to prevent the spark discharge at the spark plug 10 from occurring at a desired timing.

As is apparent from the foregoing discussion, in the known ignition apparatus for the internal combustion engine, the hold current $I_H$ of the thyristor 12 is determined by the resistor 13. Further, the ignition timing signal a generated in every ignition cycle is utilized as the trigger signal for discharging the capacitor 8. Accordingly, when the electromagnetic energy stored in the booster coil 3 of the DC-DC converter 2 is released through the thyristor 12 in the high-speed engine operation, the thyristor 12 continues to remain in the conducting state for an elongated period, resulting in that the DC-DC converter is caused to remain in the interrupted state for a longer time than the period actually required. Consequently, the succeeding charging period is correspondingly shortened to render it impossible to charge the capacitor 8 adequately, providing an obstacle in realizing the stable ignition process. In particular, in the high-speed engine operation state, the trigger signal based on the ignition timing signal can not be generated at a shorter time interval, as a result of which the charge voltage d becomes further lowered, preventing the firing of the spark plug at a predetermined timing.

SUMMARY OF THE INVENTION

In the light of the state of the art described above, it is therefore an object of the present invention to provide an ignition apparatus for an internal combustion engine which can perform a stabilized ignition control by ensuring satisfactorily the capacitor charge voltage even in a high-speed engine operation.

In view of the above and other objects which will become apparent as description proceeds, there is provided according to an aspect of the present invention an ignition apparatus for an internal combustion engine, which comprises a DC-DC converter connected to a power supply source, a capacitor charged with a boosted voltage supplied from the DC-DC converter, an ignition coil having a primary winding connected to the capacitor and a secondary winding connected to a spark plug, a thyristor inserted in a discharge path of the capacitor, the discharge path including the primary winding of the ignition coil, and a trigger circuit for generating a trigger signal for turning on the thyristor in synchronism with an ignition signal generated at an ignition timing demanded for operation of the internal combustion engine, wherein the trigger circuit includes pulse generating means for sustaining the trigger signal for a predetermined time required for the capacitor to discharge, switching means for applying a voltage to a gate electrode of the thyristor for opening a short circuit formed between the gate electrode and a cathode electrode of the thyristor for a predetermined time.

With the structure of the ignition apparatus for the engine described above, the gate-cathode path of the thyristor is short-circuited upon charging of the capacitor and after discharging thereof, to thereby set the hold current of the thyristor at a large value, so that the gate voltage is applied to the thyristor only for a period during which the trigger signal is generated, i.e., only for a period required for discharging the capacitor. Thus, the DC-DC converter can be restarted after lapse of a predetermined time from the beginning of the capacitor discharge and after lapse of turn-off period, to thereby ensure the capacitor charge voltage.

The above and other objects, features and attendant advantages of the present invention will better be understood upon reading the following description of the preferred embodiments thereof taken in conjunction with the drawings.

DESCRIPTION OF THE PREFERRED EMBODIMENTS

Now, the present invention will be described in detail in conjunction with the preferred or exemplary embodiments by reference to the drawings.

Figure 1:
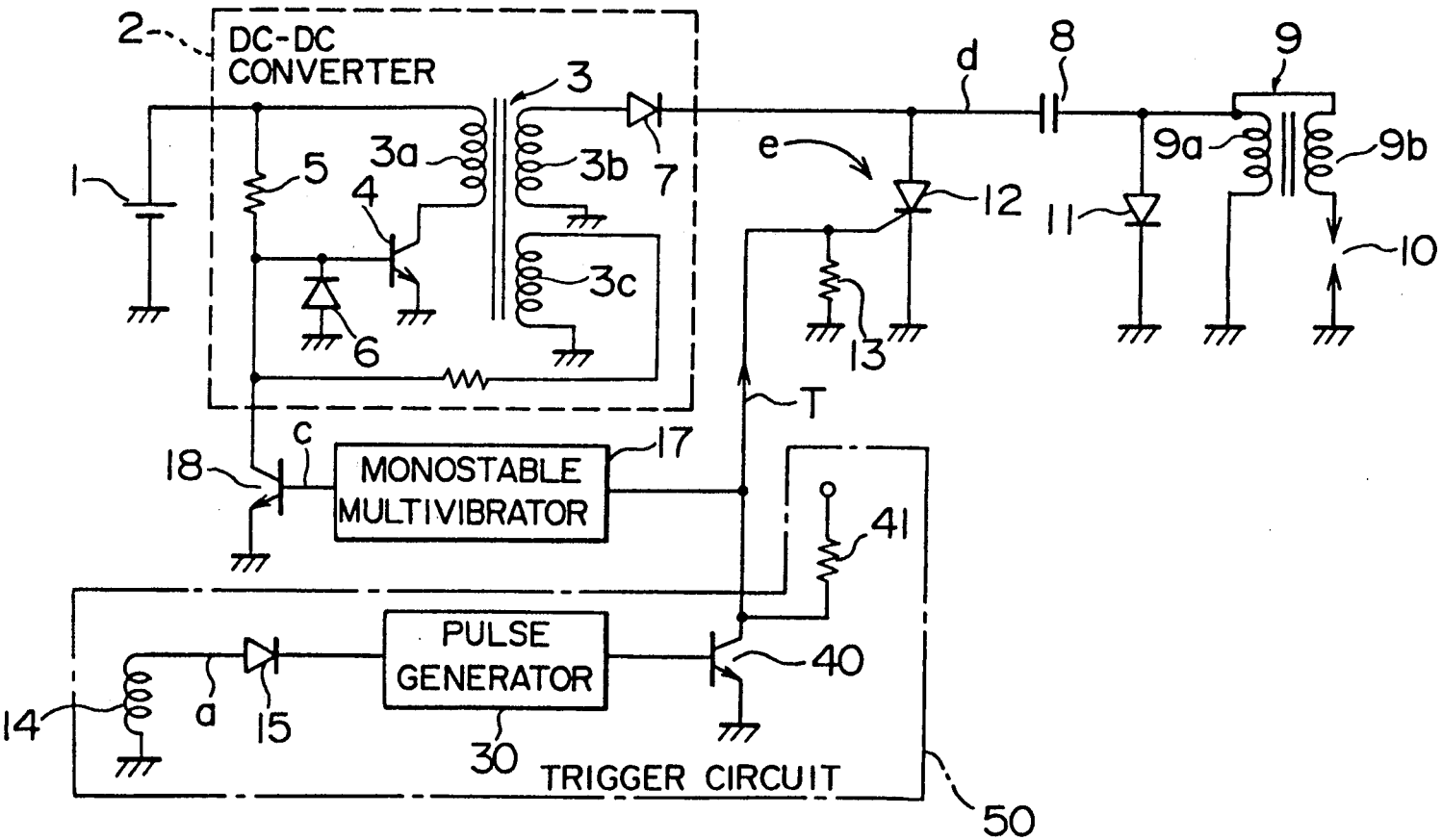
FIG. 1 is a circuit diagram showing a structure of an ignition apparatus according to an embodiment of the present invention.

FIG. 1 is a circuit diagram showing a structure of an ignition apparatus according to an embodiment of the present invention. In the figure, reference numerals 1 to 15, 17 and 18 denote the circuit components which are same as or equivalent to those shown with like reference numerals in FIG. 5. Accordingly, repeated description will be unnecessary.

In FIG. 1, a reference numeral 30 denotes a pulse generating means for generating on the basis of the ignition timing signal a trigger pulse signal of negative polarity having a predetermined duration (or pulse width) t2. This pulse generating means 30 may be constituted by a monostable flip-flop, a monostable multivibrator on the like and serves to sustain the trigger signal for a predetermined time t2 which is required for the capacitor 8 to discharge.

The output terminal of the pulse generating means 30 is connected to a base electrode of an emitter-grounded transistor 40 which constitutes a switching means adapted to be turned off in response to the trigger signal generated by the pulse generating means. A resistor 41 having a high resistance value is connected between the collector of the transistor 40 and the power supply source 1. This transistor 40 functions to open the short-circuit between the gate and the cathode of the thyristor 12 for the predetermined time t2 to thereby generate a trigger signal T in cooperation with the resistor 41 for applying a control signal to the gate of the thyristor 12.

It should be noted that the pulse generating means 30, the transistor 40 and the resistor 41 constitute a trigger circuit 50 in cooperation with the electromagnetic pickup 14 and the diode 15. The input terminal of the monostable multivibrator 17 is connected to the collector of the transistor 40.

Figure 2:
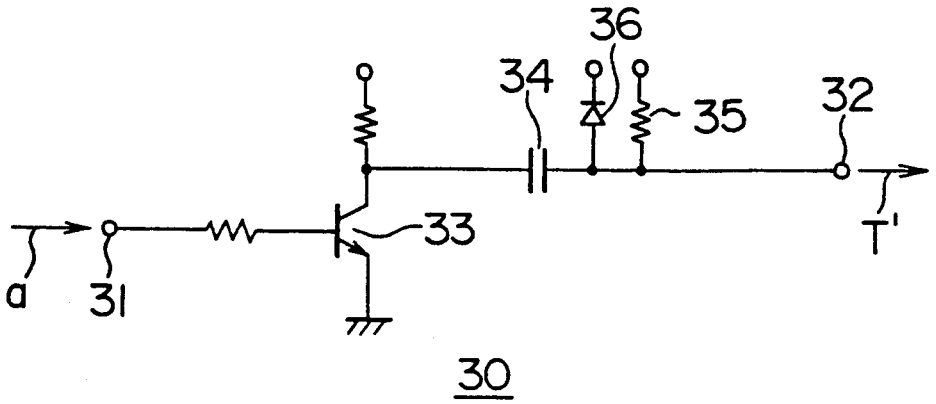
FIG. 2 is a circuit diagram showing, by way of an example, a circuit configuration of a pulse generating circuit employed in the apparatus shown in FIG. 1.

FIG. 2 is a circuit diagram showing, by way of an example, a circuit configuration of the pulse generating means 30. As can be seen in the figure, the pulse generating means 30 includes an input terminal to which the ignition timing signal a is applied from the diode 15, an output terminal 32 from which a trigger signal T' of negative polarity is generated, an emitter-grounded transistor 33 having a base connected to the input terminal 31, a capacitor 34 connected at one end thereof to a collector of the transistor 33 and at the other end thereof to the output terminal 32, a resistor 35 and a diode 36 connected in a parallel relation with respect to each other between the capacitor 34 and the power supply source or battery 1.

Referring to FIG. 2, when the ignition timing signal a is at the level "L", the transistor 33 is in the off-state. Accordingly, the trigger signal T' assumes a high level "H". When the ignition timing signal a rises up to the level "H", the transistor 33 is thereby turned on so that the capacitor 34 discharges via the now conductive transistor 33, thus lowering the voltage at the output terminal 32 into the ground level. As a result, the trigger signal T' at the output terminal 32 becomes low. From this time, the capacitor 34 is being charged by the battery 1 via the resistor 35 whereby the charged voltage of the capacitor 34 gradually increases, thus rendering the trigger signal T' at the output terminal 32 to a high level "H" after the lapse of a predetermined time t1. Subsequently, when the ignition timing signal a falls to the level "L", the transistor 33 is turned off and the trigger signal T' continues to be at the high level "H". The predetermined time t1 is previously so set as to be longer than 20μ sec. or so in correspondence to the time required for the capacitor 8 to discharge, on the basis of the values of the capacitor 34 and the resistor 35, respectively.

Figure 3:
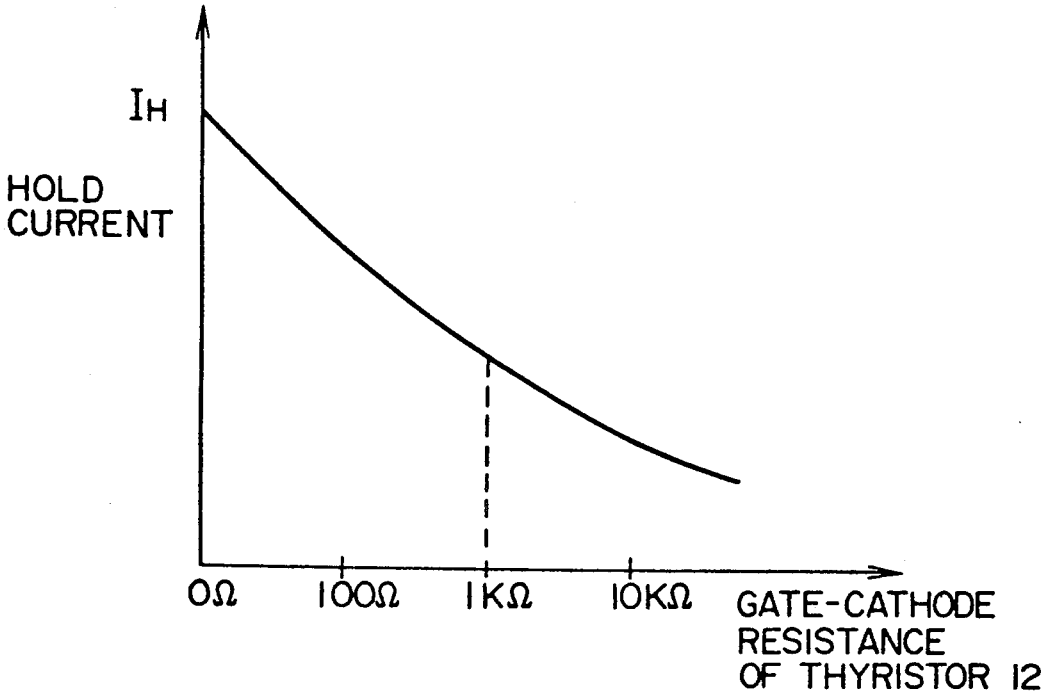
FIG. 3 is a characteristic diagram illustrating graphically a relation between a gate-cathode resistance of a thyristor and a hold current $I_H$.

FIG. 3 is a characteristic diagram illustrating graphically a relation between a gate-cathode resistance of the thyristor 12 and the hold current $I_H$. As can be seen, the hold current $I_H$ increases, as the resistance value between the gate and the cathode of the thyristor 12 becomes lower.

Figure 4:
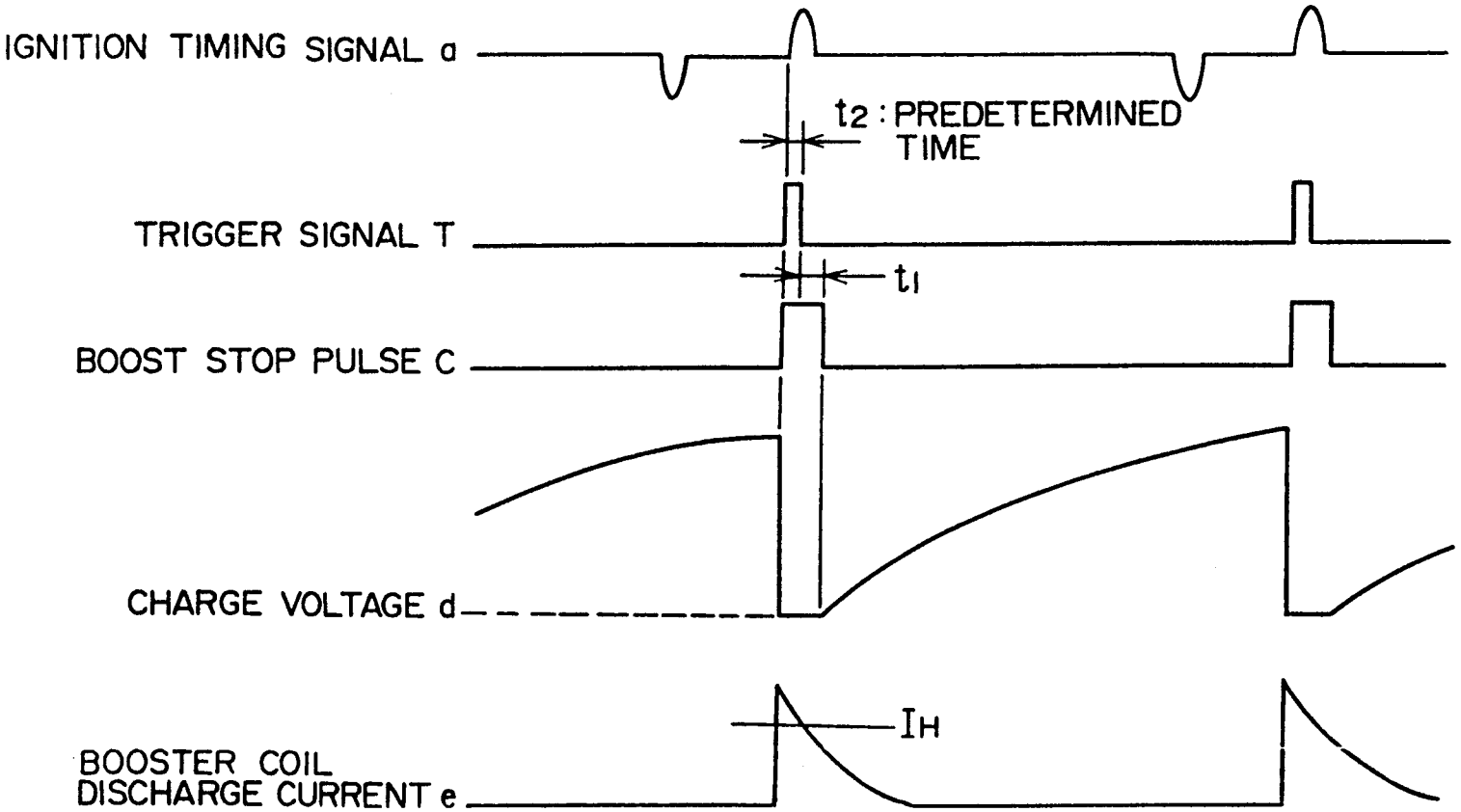
FIG. 4 is a waveform diagram illustrating waveforms of signals generated at various circuit points shown in FIG. 1.
Figure 5:
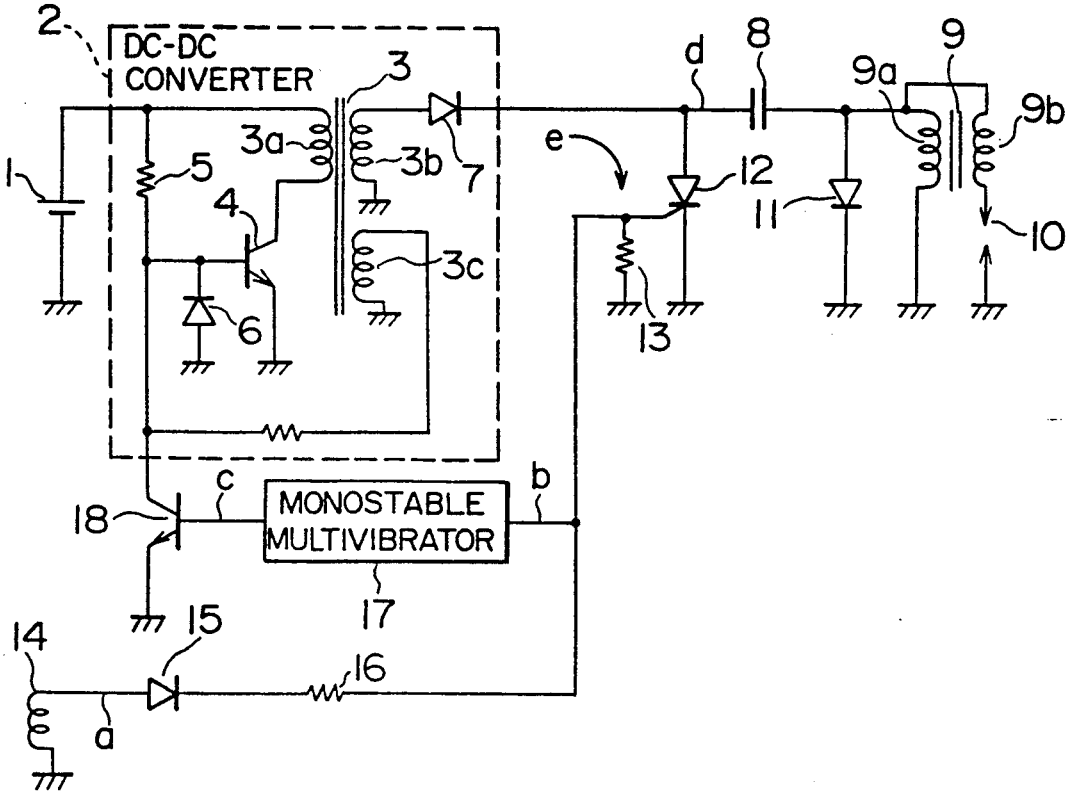
FIG. 5 PRIOR ART
FIG. 5 shows a circuit configuration of a capacitor discharge type ignition apparatus known heretofore in which a DC-DC converter is employed.
Figure 6:
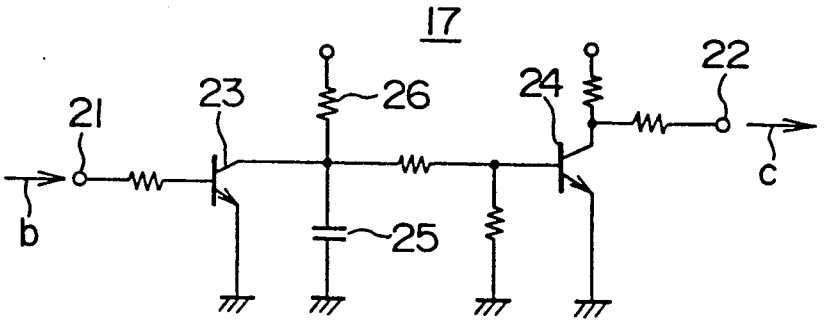
FIG. 6 PRIOR ART
FIG. 6 is a circuit diagram showing a configuration of a monostable multivibrator shown in FIG. 5.
Figure 7:
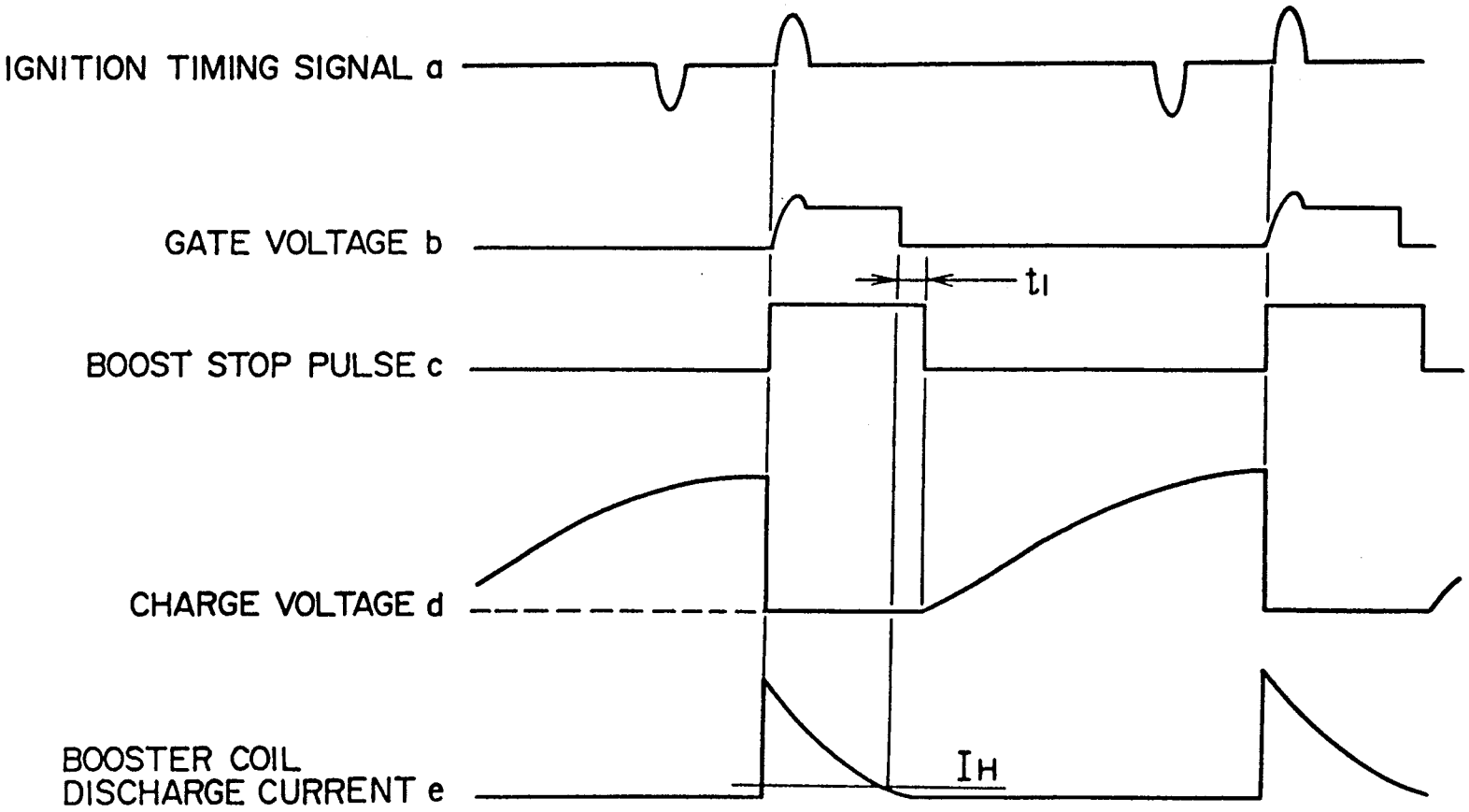
FIG. 7 PRIOR ART
FIG. 7 is a waveform diagram for illustrating operation of the conventional ignition apparatus shown in FIG. 5.

FIG. 4 is a waveform diagram illustrating waveforms of signals generated at various circuit points shown in FIG. 5. The waveform T is that of the trigger signal having a pulse width t2 and applied to the gate of the thyristor 12. In this case, since a short-circuit is formed between the gate and the cathode of the thyristor 12 in the off-state of the trigger signal T, the hold current $I_H$ is set at an extremely high level. Consequently, the thyristor 12 is caused to turn off without fail during a time which is shorter than a sum of the aforementioned predetermined time t2 and the turn-off time (i.e., shorter than the sum of t1 and t2).

Next, description will turn to operation of the ignition apparatus shown in FIG. 1.

Upon generation of the ignition timing signal a in the charged state of the capacitor 8, the pulse generating means 30 generates the trigger signal for a predetermined period which is longer than the time required for the capacitor 8 to discharge (ca. 20μ sec.), to thereby turn off the transistor 40. Thus, a control signal is applied to the gate of the thyristor 12 via the resistor 41 as the trigger signal T, resulting in that the thyristor 12 is turned on, whereupon the electric charge (voltage d) of the capacitor 8 is discharged through the primary winding 9a of the ignition coil 9 and the thyristor 12, giving birth to a spark discharge at the spark plug 10.

When the trigger signal T becomes off upon the lapse of the predetermined time t2 after the beginning of the above-mentioned discharge, the transistor 40 resumes the on-state. Since the short-circuit is then formed between the gate and the cathode of the thyristor 12, the gate voltage immediately falls to zero.

As can be seen from the characteristic diagram, the hold current $I_H$ is set at several times as high a level when compared with the level in the case only the resistor 12 (1 kΩ) is provided. Accordingly, the thyristor 12 can be turned off immediately after the lapse of the predetermined time t2 even when the booster coil discharge current e flows to the thyristor 12. Subsequently, after the lapse of the turn-off time t1, the monostable multivibrator 17 activates the DC-DC converter 2 by resetting the boosting operation stop pulse c.

In this manner, the DC-DC converter 2 restarts the boosting oscillation upon lapse of the aforementioned sum period (t1+t2) after the beginning of the discharge from the capacitor 8, whereby the stop or pause time is suppressed to a necessary minimum, which means that an adequate or sufficient time can be ensured for charging the capacitor 8 even in a high-speed engine operation, whereby the reliability of the ignition control can be enhanced.

While the invention has been described in terms of its preferred embodiments, it should be understood that numerous modifications may be made thereto without departing from the spirit and scope of the invention as defined in the appended claims. It is therefore intended that all such modifications fall within the scope of the claims.

What is claimed is:

1. An ignition apparatus for an internal combustion engine, comprising:

a DC-DC converter connected to a power supply source;

a capacitor charged with a boosted voltage supplied from said DC-DC converter;

an ignition coil having a primary winding connected to said capacitor and a secondary winding connected to a spark plug;

a thyristor inserted in a discharge path of said capacitor, said discharge path including the primary winding of said ignition coil; and a trigger circuit for generating a trigger signal for turning on said thyristor in synchronism with an ignition timing signal generated at an ignition timing demanded for operation of said internal combustion engine;

wherein said trigger circuit includes:

pulse generating means for sustaining said trigger signal for a predetermined time required for said capacitor to discharge;

switching means for applying a voltage to a gate electrode of said thyristor for opening a short circuit formed between said gate electrode and a cathode electrode of said thyristor for said predetermined time.

2. An ignition apparatus according to claim 1, wherein said pulse generating means includes an input terminal to which said ignition timing signal is applied, an emitter-grounded transistor having a base connected to said input terminal and a collector connected to a capacitor, while said switching means includes an emitter-grounded transistor having a base connected to said capacitor and a collector connected to said gate electrode of said thyristor.

* * * * *